United States Patent [19]

Osborne et al.

[11] Patent Number: 4,575,077

[45] Date of Patent: Mar. 11, 1986

[54] EXERCISE BENCH

[75] Inventors: Ralph Osborne, Irvine; Dennis C. Phelps, Orange, both of Calif.

[73] Assignee: Weider Health & Fitness, Woodland Hills, Calif.

[21] Appl. No.: 535,353

[22] Filed: Sep. 23, 1983

[51] Int. Cl.[4] ..... A63B 21/00

[52] U.S. Cl. ..... 272/134; 272/123; 272/144

[58] Field of Search ..... 272/144, 123, 134, 145, 272/109, 117, 118, 138; 128/74; 269/323, 324, 325

[56] References Cited

U.S. PATENT DOCUMENTS

| | | | |
|---|---|---|---|
| 2,152,431 | 3/1939 | Jensen | 125/25 R |
| 2,724,592 | 11/1955 | Pfaus | 272/144 |
| 2,783,045 | 2/1957 | Bosch | 272/144 X |
| 3,006,643 | 10/1961 | Ryan | 272/144 |
| 3,342,485 | 9/1967 | Gaul | 272/145 |
| 4,098,502 | 7/1978 | Faust | 272/144 |
| 4,227,689 | 10/1980 | Keiser | 272/130 |
| 4,358,109 | 11/1982 | Schrems | 272/134 X |
| 4,396,191 | 8/1983 | Metler | 272/123 |
| 4,509,746 | 4/1985 | Mask | 272/144 X |

*Primary Examiner*—Richard J. Apley
*Assistant Examiner*—Robert W. Bahr
*Attorney, Agent, or Firm*—Blakely, Sokoloff Taylor & Zafman

[57] ABSTRACT

An improved exercise bench is disclosed having a frame, a generally horizontal platform supported by the frame, the platform being divided into a head end and foot end which are hinged together transverse to the long axis of the bench, the head and foot ends being angularly movable with respect to each other so that the hinge can be raised or lowered from a horizontal position thereby improving the range of motion, safety, and muscle group isolation achieved when performing leg exercises thereon.

13 Claims, 6 Drawing Figures

3
3
4
4
6
6
D

EXERCISE BENCH

FIELD OF THE INVENTION

The present invention relates to the field of physical exercise equipment and, more particularly, to an improved weight lifting exercise bench.

BACKGROUND

Weight lifting exercise benches have been known in the art for a number of years. More recently, as physical fitness has gained greater public interest and awareness, a number of developments have occurred in the design and use of exercise benches.

The original exercise bench, which is still in use, comprises a flat raised horizontal platform supported by a frame upon which a user lies while performing various arm exercises, such as bench presses and pullovers (which develop the triceps and chest muscle groups.)

The use of this original bench has limitations, in that an assistant was generally required to hand the weights to and take the weights from the bench user. Moreover, a bench user, who performed exercises thereon without assistance, could be injured if he became exhausted and was unable to escape from under the weights.

To improve the above-described original bench design, vertical support members at one end of the bench were extended above the level of the platform and "J"-shaped hook members were added to the upper portions of the extended vertical support members, thereby allowing the barbell weights to be supported above the users head and shoulders. This improved exercise bench was therefore, more convenient and safer in that a user could install a barbell on the "J"-shaped hook without assistance, and could place the barbell thereon after completion of his exercise so that he could escape from under said barbell.

Thereafter, exercise benches were provided with a platform having means for slanting the head end thereof upward relative to the horizontal portion of the end of the platform supporting a user's trunk. Using the aforementioned configuration, a weight lifter, by bench pressing with his upper torso inclined upward from a horizontal position, is required to use certain muscle groups of the upper chest and shoulders, which muscle groups would not otherwise be exercised to the same extent.

Another prior art improvement to exercise benches was the addition of a leg exercising means. These prior art leg exercising means are of two types, although many contemporary benches comprise both types in a single embodiment. The first type of such leg exercise means enables the development of the front thigh muscles, and more specficically, the quadriceps femoris (rectus femoris, vastus intermedius, vastus medials) vastus internua, sartorius, and patella tendon. In this exercise, the user sits or lies on his back on the platform with his legs hanging downward over one end thereof. The user's legs are tucked behind a padded member which is connected to the end of a vertical bar extending downard, the vertical bar being pivotally connected at its other end to the frame of the bench near the user's knees, such that the said vertical bar may be rotated about its pivot axis to a position approximately planar with the platform. Thus, when the user straightens his leg by flexing the quadriceps, he pivots his lower leg forward approximately 90° so that it is planar with the platform. A resistance may be added to the pivoting bar such as weights, an elastic or spring means, hydraulic pressure resistance or a pulley system.

This leg exercise means is deficient in at least two respects. Firstly, the lower leg which has a pivoting range at the knee of 135° or more, is not provided with its full range of motion, and therefore, the full potential benefit of the exercise is not achieved. Generally, the greater the range of angular movement of a joint during an exercise, the more benefit is derived from that exercise. Secondly, there is a tendency for some bench users performing this leg exercise to lift the whole leg from the hip rather than just using the quadriceps (e.g. to cheat on the exercise). Therefore, proper isolation of the select muscle groups for which this exercise is designed is not achieved using the prior art device. The present invention solves the foregoing problems.

The second type of leg exercise means associated with the use of an exercise bench enables the development of the back thigh and buttocks muscles, and more specifically, the hamstrings (biceps femoris, semimembranosus) and gluteus maximus. In this exercise, a user lies on the bench platform on his stomach with his leg tucked under a padded portion of a horizontal bar extending approximately planar with the platform, which bar is pivotally connected to the frame in a manner similar to the aforementioned leg extension exercise bar. Weights or other resistance means are applied to the bar as previously described. The user curls his lower legs upward and towards his buttocks.

This prior art exercise bench is deficient in a number of respects in connection with the performance of the back leg and buttocks exercise described above. In performing this exercise on the prior art flat bench, as the horizontal bar is raised by the user's legs, the hips act as a fulcrum between the leg exercise bar pushing downward and backward on the leg, on the one hand, and the weight of the upper torso of the user, on the other hand. There is a tendency in this exercise to flex the back muscles to resist this fulcrum effect and to utilize the upper torso to rock or jerk the leg exercise bar upward. This rocking or jerking, in turn, can cause back muscle strain or more serious back injury. The present invention minimizes the risks of such strain or injury. The present invention also allows the user to isolate the muscle groups for which this exercise is intended, by making it difficult to utilize other muscles to cheat on the exercise.

To facilitate the performance of the leg extension exercise, there is a prior art exercise bench having a platform including head and foot sections divided by a hinge which is fixed in position at the horizontal plane of the platform, and a means for raising the end of the foot section of the platform. Using this bench, the above-noted deficiencies with regard to the leg extension exercise are avoided. However, this prior art bench cannot be used or adapted to aid in the performance of the leg curl exercise for which the hinge should be raised above the level of the platform.

A prior art bench is also available having a platform fixed in the shape of an upside down "V" to overcome the above-described deficiencies of a flat bench for performing the second type of leg exercise. However, this prior art bench is conveniently usable for performing the leg curl. Moreover, none of the prior art exercise benches disclose the selective vertical translation of the pivoting means in the middle section of the platform.

Prior art exercise benches are also known in the art which combine the two types of leg exercise means into a single apparatus. In such benches, the horizontal bar is attached perpendicularly to a downward extending vertical bar to form a combination leg exercise means, which attaches to the frame of the bench near the intersection between said bars. The foregoing deficiencies of the two leg exercise means applies equally to this combination system.

There is a trend in the improvement of these exercise benches toward providing improved safety, increasing the number of different muscle groups which can be developed by its use, and enabling the selective isolation of various muscle groups for exercise. Thus, a weight lifter can specfically strengthen desired muscle groups. Similarly, body builders who, unlike weight lifters, exercise to develop the size and appearance of specific muscle groups, rather than strength, can also selectively isolate desired muscle groups. The present invention enables exercise bench users to achieve their goals by providing safer exercise equipment and improved isolation of the muscle groups.

SUMMARY OF THE INVENTION

The present invention comprises an improved exercise weight lifting bench having a frame, a platform supported by said frame, said platform being divided into a head section and a foot section, each section having first and second ends, each of said sections being pivotable with respect to said frame at their respective second ends, a first pivot means interconnecting said first ends of said head and foot sections, said first pivot means having a generally horizontal pivot axis transverse to the length of said platform, a means for adjusting the horizontal distance between the second ends of said head and foot sections to compensate for horizontal loss when said first pivot means is vertically displaced, and a means for raising and/or lowering said fist pivot means in a generally vertical direction from a horizontal plane defined by the position of said head and foot sections when they are coplanar, said first raising and/or lowering means being coupled to said first pivot means, and a means for securing said platform in the above-described positions. In the preferred embodiment, the invented exercise bench comprises both a front thigh, and a back thigh and buttocks exercise means.

When said first pivot means is lowered below the plane defined by the head and foot sections when they are horizontal, the thigh of a user laying on his back is angled upward and the lower portion of the leg is vertical thus forming an angle of greater than 90°. This angle forces the user to limit his movements to the muscles involved, thereby concentrating on the exercise of his front thigh muscles. The invented exercise bench also provides a greater range of rotational motion of the leg during the exercise.

When the first pivot means is raised above the planar position, the user lies on the platform on his stomach and his waist is bent over the crest formed at the first pivot means so that his upper torso extends on the head section of the platform. Thus, when the user curls the back leg exercise means towards his buttocks, the backward pull of this action is resisted mainly by the force of the upper body against the downward slanting platform of the bench, rather than solely by the weight of user's torso. Due to the configuration of the invented bench, there is a lesser tendency for the user to arch or jerk his back, and consequently, there is less risk of injury.

Other features of this invention as well as further uses and advantages will become more readily apparent by reference to the following drawings.

DETAILED DESCRIPTION

Figures 1, 2:
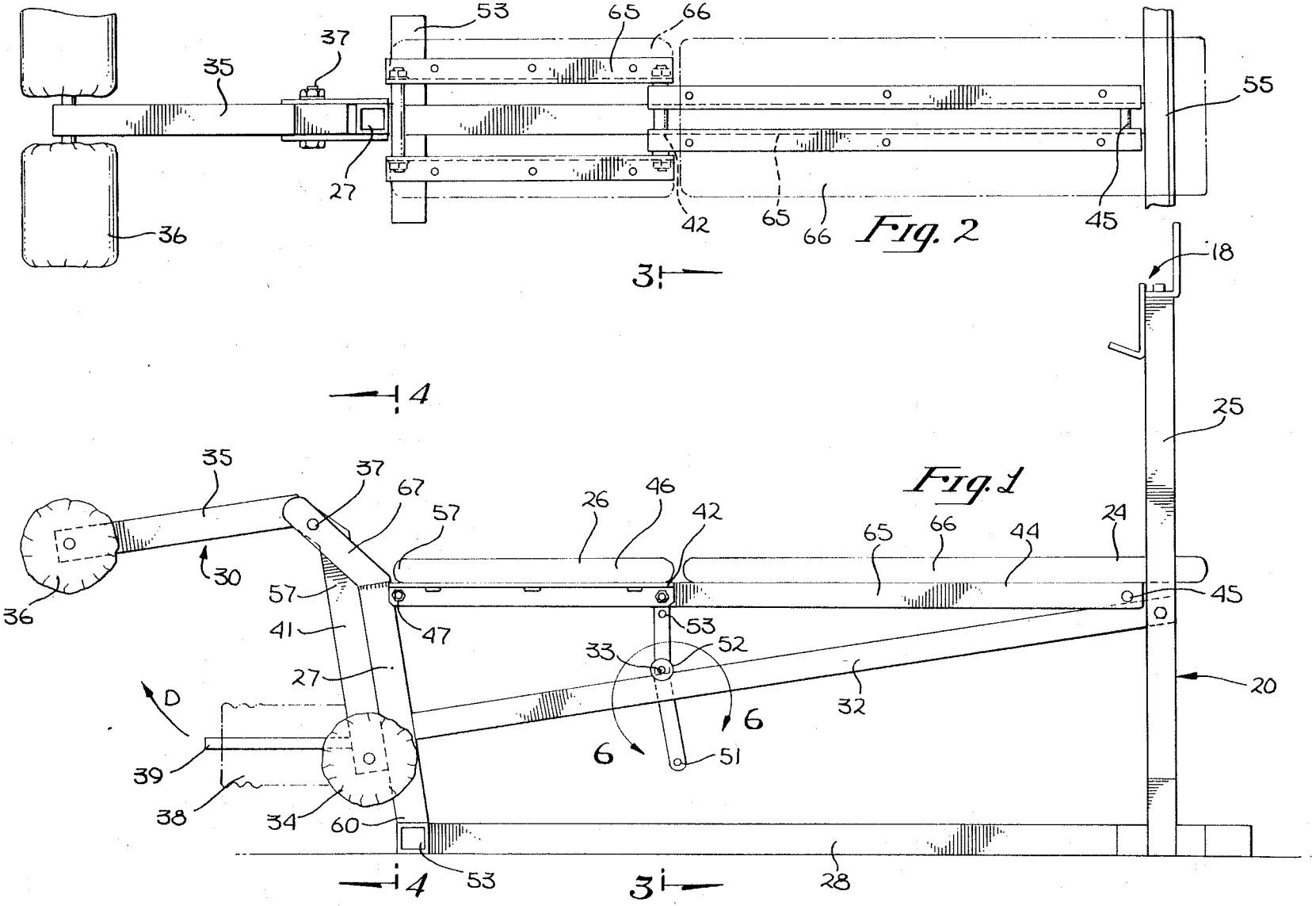
FIG. 1 is a side view of the invented exercise bench in the planar position.
FIG. 2 is a top plan view of the invented exercise bench with the platform pads shown in phantom lines.
Figure 3:
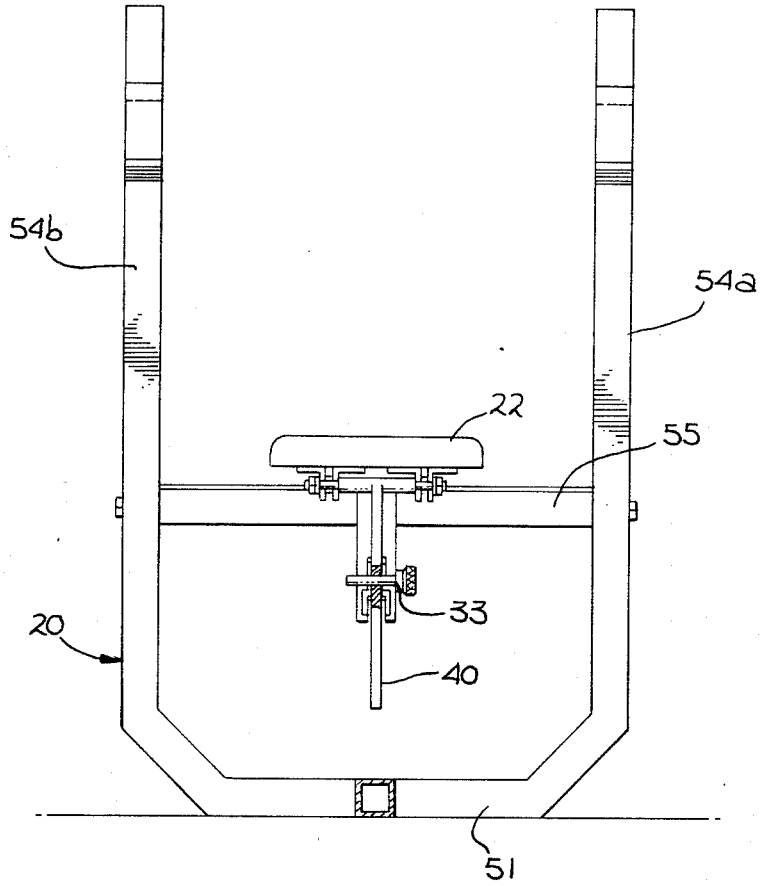
FIG. 3 is an end view of the invented exercise bench taken through lines 3—3.

Referring now to the drawings wherein like numerals identify like elements, the invented bench 10 generally comprises a frame 20 having a head end 24 and foot end 26, a platform 22 installed horizontally on said frame, and a leg exercise means 30 pivotally connected to said frame 20.

The frame 20 generally comprises a head end base 51 disposed on the ground at the head end transverse to the long axis of the bench, a long axis cross-member 28 attached perpendicularly to said head end base 51 and disposed on the ground along the long axis of the bench, a foot end base 53 attached perpendicularly to said long axis cross-member 28 and disposed on the ground parallel to said head end base, a vertical head end support means 25 comprising two vertical bars **54*a* and 54*b* extending vertically upward from the ends of said head end base 51, a horizontal head end cross-member 55 extending between said vertical bars 54*a* and 54*b* for structural support, and a foot end vertical support member 27 extending upward from the foot end base 53 approximately perpendicular to the ground. In the preferred embodiment, the foot end vertical support is slanted, having its top portion 59 further away from the head end 24 than its bottom portion 60** to permit a greater range of motion of the front leg exercise means, as will be explained below.

While the preferred embodiment of the frame 20 has just been described, it will be appreciated by one skilled in the art that many variations and modifications of the bench frame can be made without departing from the nature and scope of the present invention.

The frame is also provided with a horizontal supporting bar 32, which provides structural support for the bench as well as operatively engages and supports the platform 22. The horizontal supporting member 32 is connected, at one end, to said head end cross-member 55 and, at the other end, to said foot end vertical support member 27. In the preferred embodiment the horizontal support member 32 slopes downward from said head end 24 to said foot end 26 of said bench 10. A receiving portion 35 of said horizontal supporting bar 32 is designed to receive a vertical support bar 40 which partially supports said platform 22.

The platform 22 is bisected, transversely to the long axis, thereof by a first pivot means 42, into head platform section 44 and foot platform section 46. Preferably, the first pivot means 42 is disposed corresponding approximately to the position of the hips of a typical user lying on the platform 22 with his knees adjacent the foot end 26, such that the two above-described leg exercises can be performed. First pivot means 42 is designed to permit upward and downward movement thereof from the planar position defined by the position of the platform when said head and foot sections are substantially coplanar as shown in FIG. 1.

The foot platform section 46 is pivotable with respect to the foot end vertical support member 27 at 47. The head platform section 44 preferably engages the horizontal support member 32, such that it is free to pivot along a vertical plane and move horizontally along the length of said horizontal support member 32, to compensate for loss in horizontal length of said platform 22 when said first pivot means 42 is raised or lowered from the planar position (see FIG. 5 and compare with FIG. 1). In the preferred embodiment, this is achieved by the installation of a pin 45 in said head platform section 44, which engages said horizontal support member 32, either rolling or sliding thereon. In an alternative embodiment, said horizontal support member can be provided with a slot in which pin 45 is disposed.

The vertical support member 40 is preferably attached to said platform at the first pivot means 42, although coupling of said platform 22 to said vertical support bar 40 at any position along said platform 22 is contemplated within the scope of the present invention.

In the preferred embodiment, the vertical support member 40 has at least three detent positions. A first detent 51*a* is disposed furthest away from said first pivot means 42*a*, such that when said detent 51*a* engages said horizonal support member 32, said hinge 42*a* is raised above the planar level, as shown in solid lines in FIG. 5. When a second detent 52*a* engages said horizontal support member 32, the platform 22 is substantially horizontal and planar as shown in FIG. 1. When a third detent 53*a* engages said horizontal support member 32, as shown in phantom lines in FIG. 5, the head platform section 44*a* lies on the horizontal support member 32, and no significant amount of force is placed on said vertical support member 40*b* in this configuration.

The remaining portions of the invented exercise bench are substantially the same as hereinbefore described, the difference in position being identified by the letter "a" after the identification number denoting those previously described elements in the raised position above the aforementioned horizontal plane, and the letter "b" after the identification number denoting those elements in the lowered position below said plane.

Figure 5:
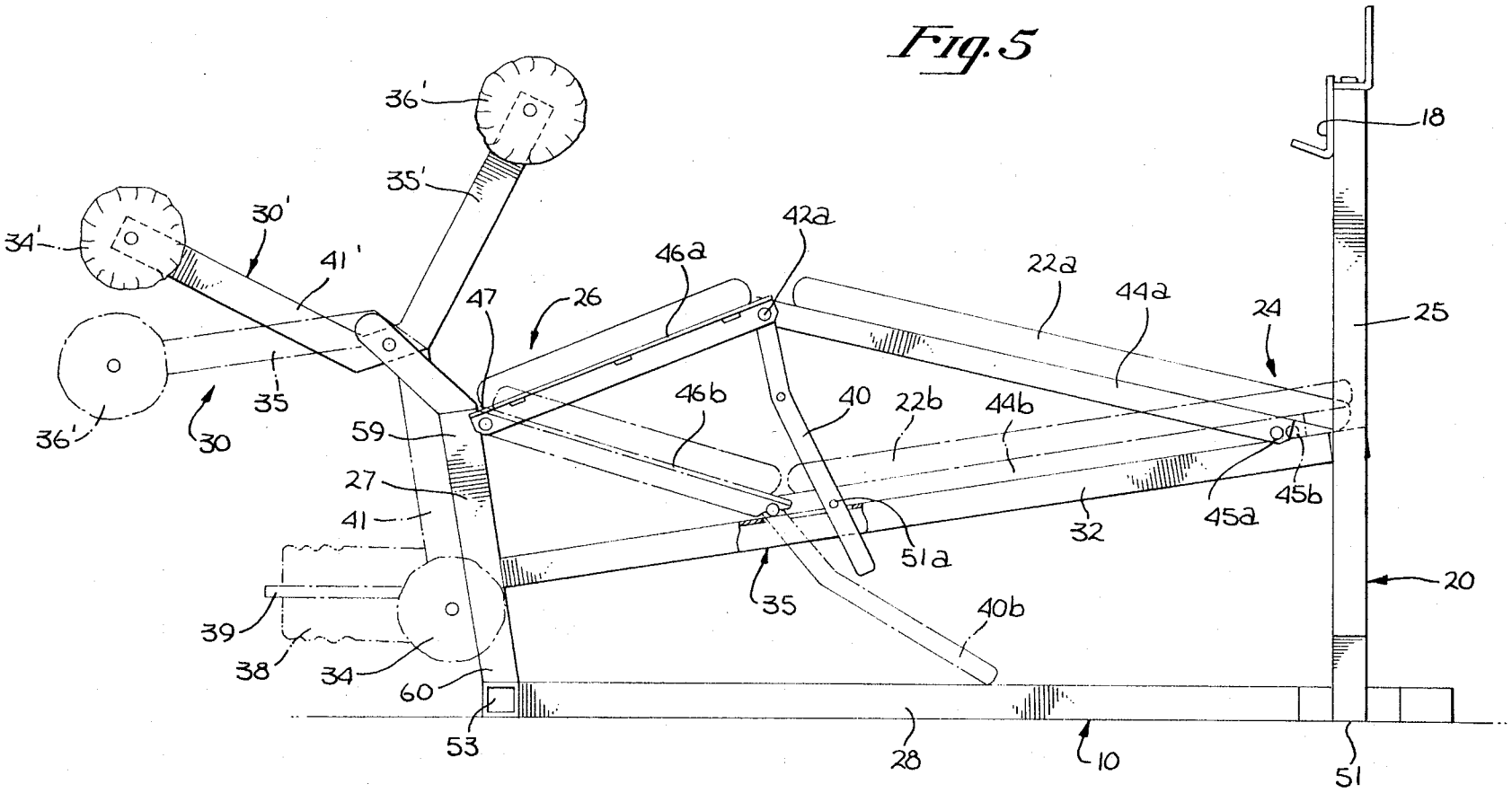
FIG. 5 is a side view of the invented bench showing the mid-platform hinge in the raised position in solid lines and in the lowered position in phantom lines, and showing the leg exercise means in rest position in phantom lines and in raised position in solid lines.

As exemplified in FIG. 5, a cutaway view of the intersection between vertical support member 40 and horizontal support member 32, the vertical support member 40 passes through a slot in the horizontal support member 32 and is supported by a pin 33 passing through said vertical member 40 at a predetermined detent, said pin 33 thereby engaging said horizontal support member 32.

Figure 6:
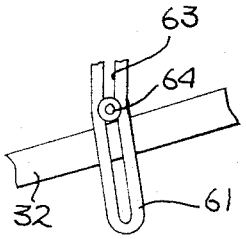
FIG. 6 is another embodiment of the invented bench taken through lines 6—6, wherein the coupling means is provided with a continuous adjustment.
Figure 4:
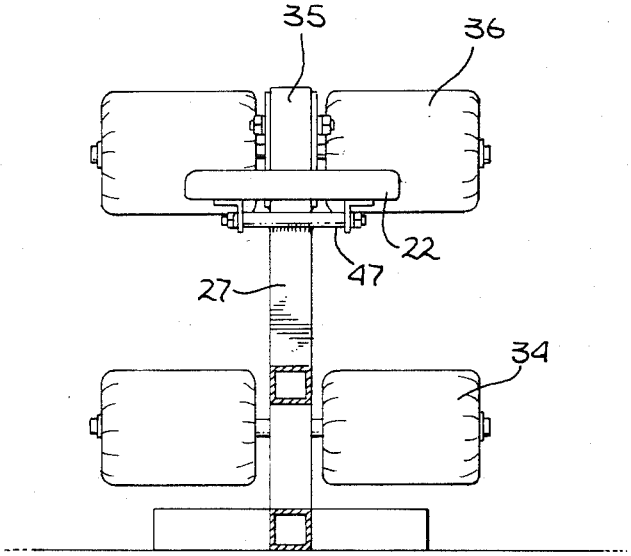
FIG. 4 is an end view of the invented exercise bench taken through lines 4—4.

In another embodiment of this invention, shown in FIG. 6, the vertical support member 40 is continuously adjustable with respect to horizontal support member 32, without any predetermined detents. In this embodiment, the vertical support member 61 comprises a slot 63 through which a bolt assembly 64 passes to secure said vertical support member 61 in a selected position.

As further exemplified in the drawings, the platform 22 comprises a platform frame 65 and platform cushion 66 disposed thereover for obvious comfort reasons.

The preferred embodiment of the invented bench further comprises the following elements. At least one "J"-shaped hook 18 is disposed on said head end vertical stand for supporting barbell weights for bench pressing and similar exercises.

At the foot end of the invented exercise bench 10 is a combination leg exercise means 30 comprising a front leg extension bar 41 including a padded portion 34 and a back leg curl exercise bar 35 including a padded portion 36. The dual leg exercise 30 means is pivotally attached at 37 to extension 67 on frame 20. In using the leg exercise means 30 from resting position, leg exercise means 30 is moved in direction D into a second position denoted by 30'. The aforementioned leg exercise means components disposed in the raised position, are similarly numbered with a "'" after the identification numbers to indicate the raised position.

Weights 38, shown in phantom lines, may be installed on post 39, thereby increasing the resistance to pivoting. In other embodiments, resistance may be applied to said leg exercise means 30 by spring or elastic attachments, hydraulic means, pulley systems, gears and the like.

In another embodiment of the present invention, the head platform section 44 can be fitted with head end raising means, which is well known in the art, so that the head platform section 44 is raised to a predetermined height above the foot end 26, thereby allowing certain bench pressing and other exercises to be performed.

In the preferred use of the present invention for exercising the front thigh, a user positions the platform in the lowered position with the vertical support 40*b* set in detent 53*b*, as illustrated in FIG. 5. The user lays on his back with his hips preferably approximating first pivot means 42*b*, such that he comfortably bends at the waist near first pivot means 42. The user's legs must bend at the knees over the end 57 and are disposed behind padded member 34. The user then tenses his front thigh muscles thereby straightening his leg. During the lift, the back of the knee acts as a fulcrum so that his upper torso presses forward toward and against the head platform section 56*b*. Due to this forward force, it is more difficult for a user to raise his legs from the hip (and thereby cheat on the exercise). Therefore, the flexion of the front thigh muscles is specifically concentrated to those muscles in this front leg extension exercise using the present invention. Moreover, since the angle between the upper leg and lower leg of a user lying on the bench as described above, is greater than 90° angle disclosed in the prior art exercise benches, the well known benefits gained by this longer range of motion are also achieved.

In the preferred use of the present invention for exercising the hamstrings and other muscle groups in the back of the thigh, the user adjusts the platform 22, such that detent 51*a* engages horizontal support member 32. The user then lies on his stomanch on platform 22*a*, preferably bending at the waist near first pivot means 42*a*. The back of the users lower leg abuts the bottom side of padded member 36. The user flexes his leg at the knee by curling it upward and forward toward his buttocks. The forward motion of the leg is resisted by the upper torso pressing towards the foot end 26 of the bench 10 and against the downward sloping head end section 44*a* of the platform, so that the counteracting forces of upper torso against the platform substantially eliminate the need for the user to do the same work with his back, and thus, the risk of back strain is reduced. Accordingly, because the user's body is draped over the platform, it is also more difficult to arch or jerk the back in order to cheat on this exercise. Thus, the possibility of back strain is further reduced. In addition, the muscles of the back thigh and buttocks are particularly angled with respect to the resistance load, so that these muscles are isolated in this exercise.

It will also be apparent to one of ordinary skill in the art that while a preferred embodiment has now been shown and described, various modifications can be made without departing from the spirit and scope of the invention.

We claim:

1. In an improved exercise bench of the type having (i) a frame; (ii) a platform supported by said frame, said platform comprising generally planar head and foot sections, each having first and second ends, said head and foot sections being pivotally connected to one another at their respective first ends by first pivot means having a generally horizontal pivot axis transverse to the length of said platform; and (iii) means for exercising a user's legs pivotally affixed to said frame at the end thereof adjacent said second end of said foot section;

the improvement comprising:

(a) means for selectively translating said first pivot means in a generally vertical direction to a position above or below the plane defined by said head and foot sections when they are horizontal, said translating means being coupled to said first pivot means;

(b) means for securing said first pivot means in at least one translated position in said generally vertical direction;

(c) a support means disposed below the plane defined by said head and foot sections when they are horizontal, said support member being adjustably coupled to said first pivot means securing means to support said first pivot means in a predetermined vertical position;

(d) second pivot means interconnecting said frame and said second end of said foot section; and (e) means for adjusting the distance between said second ends of said foot and head sections whenever said first pivot means is vertically translated, said distance adjusting means being coupled to said platform, whereby, a user of said improved exercise bench can select the vertical position of said first pivot means, thereby selectively determining the spatial relationship between said head section and said foot section, so as to enhance the degree of exercise provided to said user by said leg exercise means and to decrease the risk of injury to said user.

2. The improved exercise bench of claim 1 wherein said translating means comprises a substantially vertical elongated bar having a plurality of detents disposed long the length thereof in predetermined increments for selectively determining, in corresponding increments, said point at which said support means is coupled to said translating means.

3. The improved exercise bench of claim 1 wherein said translating means comprises an elongated bar and is slidably coupled to said support means.

4. The improved exercise bench of claim 1 wherein said translating means comprises a bar having a length sufficient to enable the selective translation of said first pivot means to selected positions above the plane defined by said foot and head sections when they are disposed co-planarly.

5. The improved exercise bench of claim 1 wherein said translating means comprises a bar having a length sufficient to enable the selective translation of said first pivot means to selected positions below the plane defined by said foot and head sections when they are disposed co-planarly.

6. The improved exercise bench of claim 1 wherein said translating means comprises a bar having a length sufficient to enable the selective translation of said first pivot means to be both raised and lowered to selected positions above and below the plane defined by said foot and head sections when they are disposed co-planarly.

7. The improved exercise bench of claim 2 wherein said translating means comprises at least three detents, including:

a raised platform detent disposed furthest from said first pivot means, such that said first pivot means is raised above the plane defined by said foot and head sections when they are disposed co-planarly;

a planar detent disposed in an intermediate position along the length of said first member, such that said first pivot means is disposed substantially within said plane; and a lowered platform detent disposed in a position closest to said first pivot means, such that said first pivot means is disposed below said plane.

8. The improved exercise bench of claim 1 wherein said support member comprises an elongated member affixed to said frame having means for selectively coupling to said first member at predetermined positions along the length of said first member.

9. The improved exercise bench of claim 1 wherein said support means is affixed to said frame and disposed below said platform in slidable engagement with said second end of said head section, whereby, when said first pivot means is vertically translated, said second end of said head section slides toward or away from said second end of said foot section along the length of said support means.

10. The improved exercise bench of claim 9 wherein said distance adjusting means further comprises rolling means disposed between said support member and said second end of said head section, whereby said second end of said head section rolls toward or away from said second end of said foot section.

11. The improved exercise bench of claim 1 further comprising means for raising said second end of said head section to at least one position above the generally horizontal plane defined by said foot and head sections when they are disposed coplanarly, and means for securing said second end in said raised position.

12. The improved exercise bench of claim 9 wherein said support means comprises an inclined elongated bar attached to said frame at the ends thereof.

13. In an improved exercise bench of the type having (i) a frame; (ii) a platform supported by said frame, said platform comprising generally planar head and foot sections, each having first and second ends, said head and foot sections being pivotally connected to one another at their respective first ends by first pivot means having a generally horizontal pivot axis transverse to the length of said platform and (iii) means for exercising a user's legs pivotally affixed to said frame at the end thereof adjacent said second end of said foot section;

the improvement comprising:

(a) a generally vertical member coupled to said first pivot means at one end for selectively translating said first pivot means in a generally vertical direction;

(b) an inclined elongated bar attached to the ends of said frame and adjustably coupled to said vertical member so that said elongated bar supports said vertical member for securing said first pivot means in a plurality of positions in said generally vertical direction above, co-planar with and below the plane of said head and foot sections when horizontal;

(c) second pivot means interconnecting said frame and said second end of said foot sections; and (d) means for adjusting the distance between said second ends of said foot and head sections whenever said first pivot means is vertically translated, said distance adjusting means being coupled to said platform, whereby, a user of said improved exercise bench can select the vertical position of said first pivot means, thereby selectively determining the spatial relationship between said head section and said foot section, so as to enhance the degree of exercise provided to said user by said leg exercise means and to decrease the risk of injury to said user.

* * * * *